US007815529B2

(12) United States Patent
Lee

(10) Patent No.: US 7,815,529 B2
(45) Date of Patent: Oct. 19, 2010

(54) ADJUSTABLE GOLF TEE ASSEMBLY

(75) Inventor: Lien-Hsin Lee, Luchou (TW)

(73) Assignee: Moldtek Precision Corp., Taipei Hsien (TW)

( * ) Notice: Subject to any disclaimer, the term of this patent is extended or adjusted under 35 U.S.C. 154(b) by 0 days.

(21) Appl. No.: 12/356,091

(22) Filed: Jan. 20, 2009

(65) Prior Publication Data

US 2009/0258732 A1 Oct. 15, 2009

(30) Foreign Application Priority Data

Apr. 11, 2008 (TW) ..... 97113390 A

(51) Int. Cl.
*A63B 57/00* (2006.01)

(52) U.S. Cl. ..... 473/398; 473/400

(58) Field of Classification Search ..... 473/387–403; D21/717–719

See application file for complete search history.

(56) References Cited

U.S. PATENT DOCUMENTS 1,616,059 A * 2/1927 Mulvehill ..... 473/398
1,936,625 A * 11/1933 Goldman ..... 473/398
2,079,387 A * 5/1937 Sickmiller ..... 473/398
3,114,557 A * 12/1963 Cabot ..... 473/398
3,203,700 A * 8/1965 Antonious ..... 473/398
3,406,977 A * 10/1968 Voelkerding ..... 473/257
3,408,079 A * 10/1968 Kirikos ..... 473/398
3,690,676 A * 9/1972 Costa ..... 473/398
5,413,348 A * 5/1995 Basso ..... 473/393
5,672,122 A * 9/1997 Strong ..... 473/398
6,729,977 B1 * 5/2004 Young et al. ..... 473/398
6,811,499 B1 * 11/2004 Hsien ..... 473/396
6,942,583 B2 * 9/2005 Syu ..... 473/400
7,488,263 B2 * 2/2009 Lee ..... 473/394
2002/0022538 A1 * 2/2002 Choi ..... 473/396
2005/0026726 A1 * 2/2005 Barouh ..... 473/398
2009/0253536 A1 * 10/2009 Funke ..... 473/398

* cited by examiner

*Primary Examiner*—Steven Wong
(74) *Attorney, Agent, or Firm*—Muncy, Geissler, Olds & Lowe, PLLC

(57) ABSTRACT

An adjustable golf tee assembly includes a golf tee, which has a plurality of positioning portions formed in the periphery of a shank thereof at different elevations, an elastically deformable tee holder having an upright stub tube perpendicularly upwardly extending from a flat base thereof and a center through hole cut through top and bottom sides of the flat base and surrounded by the upright stub tube and a positioning portion formed on the inside wall of the upright stub tube for engagement with one of the positioning portions of the golf tee selectively, and a locating ring for sleeving onto the upright stub tube of the tee holder to lock the golf tee and the tee holder.

11 Claims, 11 Drawing Sheets

ADJUSTABLE GOLF TEE ASSEMBLY

This application claims the priority benefit of Taiwan patent application number 097113390 filed on Apr. 11, 2008.

BACKGROUND OF THE INVENTION

1. Field of the Invention

The present invention relates to a golf tee for use in golf game and more particularly, to an adjustable golf tee assembly, which allows adjustment of the elevation of the golf tee.

2. Description of the Related Art

Nowadays, more and more people are willing to play golf game for physical exercises. When playing the golf game, a golf tee is usually used to support a golf ball for hitting with a golf club. The game involves many factors such as the player's physical size and mental condition, the used tools, the hitting posture, and etc. A conventional golf tee is solid member made out of wood or plastics. A solid golf tee may break easily after a long use or when hit by a golf club. Before hitting, the elevation of the golf tee above the ground must be properly adjusted so that the player can hit the golf ball accurately with a golf club. If the elevation of the golf tee is too low, the play may have to adjust the hitting posture, causing the golf club swinging force unable to be fully carried out. However, if the elevation of the golf tee is excessively high, the player may hit the wrong part of the golf ball or miss the ball.

For easy adjustment of the elevation of the golf tee, an adjustable golf tee assembly is creased. According to this conventional design, the adjustable golf tee assembly is comprised of a wooden or plastic tee holder, which has an inner thread, and a down or plastic golf tee, which has an outer thread extending around the periphery of the shank thereof for threading into the inner thread of the tee holder. However, this design of adjustable golf tee assembly still has numerous drawbacks as follows:

1. If a player hits the golf tee or tee holder accidentally when playing golf game, the outer thread of the golf tee or the inner thread of the tee holder may be damaged. Further, the outer thread of the golf tee and the inner thread of the tee holder wear quickly with use. When the outer thread of the golf tee or the inner thread of the tee holder is damaged or starts to wear, the connection between the golf tee and the tee holder becomes unstable.

2. After a long use of the adjustable golf tee assembly, sands may be stuck in the outer thread of the golf tee and the inner thread of the tee holder. In this case, the user needs to spend a lot of time and labor in cleaning the adjustable golf tee assembly.

3. The engagement between the outer thread of the golf tee and the inner thread of the tee holder requires a high precision, complicating the fabrication of the adjustable golf tee assembly. Therefore, this design of adjustable golf tee assembly is not suitable for mass production. In consequence, the manufacturing cost of this design of adjustable golf tee assembly is high.

Therefore, it is desirable to provide a golf tee that eliminates the aforesaid problems.

SUMMARY OF THE INVENTION

The present invention has been accomplished under the circumstances in view. It is therefore the main object of the present invention to provide an adjustable golf tee assembly, which allows adjustment of the fastening depth of the golf tee in the ground. It is another object of the present invention to provide an adjustable golf tee assembly, which avoids missing of the golf tee after each application.

To achieve these and other objects of the present invention, the adjustable golf tee assembly is comprised of a golf tee, a tee holder for holding the golf tee, and a locating ring for locking the golf tee and the tee holder. The golf tee comprises a shank, a plurality of positioning portions formed in the periphery of the shank at different elevations, a head disposed at the top end of the shank for holding a golf ball, and a conical tip axially downwardly extended from the bottom end of the shank for fastening to the ground. The tee holder is made of an elastic material, comprising a flat base, an upright stub tube perpendicularly upwardly extending from the flat base, a center through hole cut through top and bottom sides of the flat base and surrounded by the upright stub tube, and a positioning portion formed on an inside wall of the upright stub tube for engagement with one positioning portion of the golf tee. The locating ring can be sleeved onto the upright stub tube of the tee holder to hold the positioning portion of the tee holder in engagement with one positioning portion of the golf tee. Further, the locating ring has an inner diameter fitting an outer diameter of the upright stub tube of the tee holder.

Further, the tee holder comprises a wire hole cut through top and bottom sides of the flat base, and a cord member inserted through the wire hole to secure the tee holder of the adjustable golf tee assembly to a tee holder of a second adjustable golf tee assembly. The cord member has a stop member respectively fixedly provided at each of the two distal ends thereof. The stop member has a diameter greater than the wire hole.

DETAILED DESCRIPTION OF THE INVENTION

Figure 1:
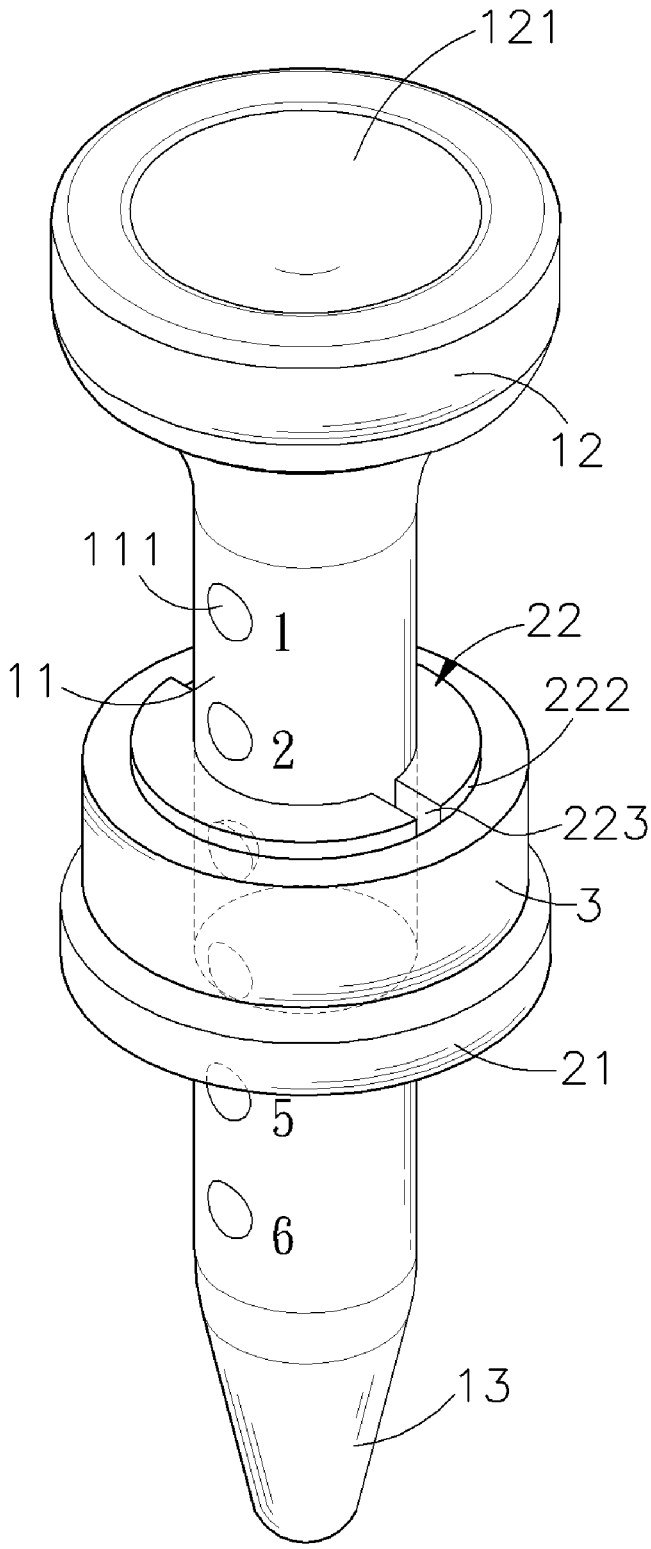
FIG. 1 is a perspective assembly view of an adjustable golf tee assembly in accordance with a first embodiment of the present invention.

Referring to FIGS. 1-5, an adjustable golf tee assembly in accordance with a first embodiment of the present invention is shown comprised of a golf tee 1, a tee holder 2 and a locating ring 3.

The golf tee 1 comprises a shank 11, a plurality of positioning portions 111 formed in the periphery of the shank 11 at different elevations, a head 12 formed on the top end of the shank 11, a recessed receiving portion 121 formed in the top wall of the head 12 for holding a golf ball, and a conical tip 13 axially downwardly extended from the bottom end of the shank 11 for fastening to the ground.

The tee holder 2 comprises a flat base 21, an upright stub tube 22 perpendicularly upwardly extending from the center area of the top side of the flat base 21, a plurality of longitudinal crevices 223 longitudinally formed in the upright stub tube 22 and extending from the flat base 21 to the topmost edge of the upright stub tube 22, a center through hole 221 cut through the top and bottom sides of the flat base 21 and surrounded by the upright stub tube 22, and a positioning portion 2211 formed on the inside wall of the upright stub split tube 22 and fitting one of the positioning portions 111 of the golf tee 1.

The locating ring 3 has an inner diameter 31 fitting an outer diameter 222 of the upright stub tube 22.

When using the adjustable golf tee assembly, sleeve the locating ring 3 onto the shank 11 of the golf tee 1 to have the locating ring 3 be stopped at the bottom side of the head 12 of the golf tee 1, and then insert the shank 11 of the golf tee 1 through the center through hole 221 of the tee holder 2. At this time, the longitudinal crevices 223 allow the upright stub tube 22 to be expanded radially outwards so that a user can conveniently adjust the elevation of the shank 11 relative to the tee holder 2. After adjustment of the golf tee 1 to the desired elevation relative to the tee holder 2 to have one selected positioning portion 111 of the golf tee 1 be in horizontal alignment with the positioning portion 2211 of the tee holder 2, the locating ring 3 is lowered to force the inner diameter 31 of the locating ring 3 against the outer diameter 222 of the upright stub tube 22, keeping the selected positioning portion 111 of the golf tee 1 in positive engagement with the positioning portion 2211 of the tee holder 2. Thereafter, the user can force the conical tip 13 of the golf tee 1 into the ground to have the flat base 21 of the tee holder 2 be stopped against the ground. By means of adjusting the elevational position of the tee holder 2 relative to the shank 11 of the golf tee 1, the user can control the insertion depth of the golf tee 1 in the ground, thereby controlling the elevation of the golf ball above the ground to fit the player's golf swing habit.

Further, the positioning portions 111 of the golf tee 1 can be recessed holes; the positioning portion 2211 of the tee holder 2 can be a protruding block for fitting the recessed holes.

Figure 6:
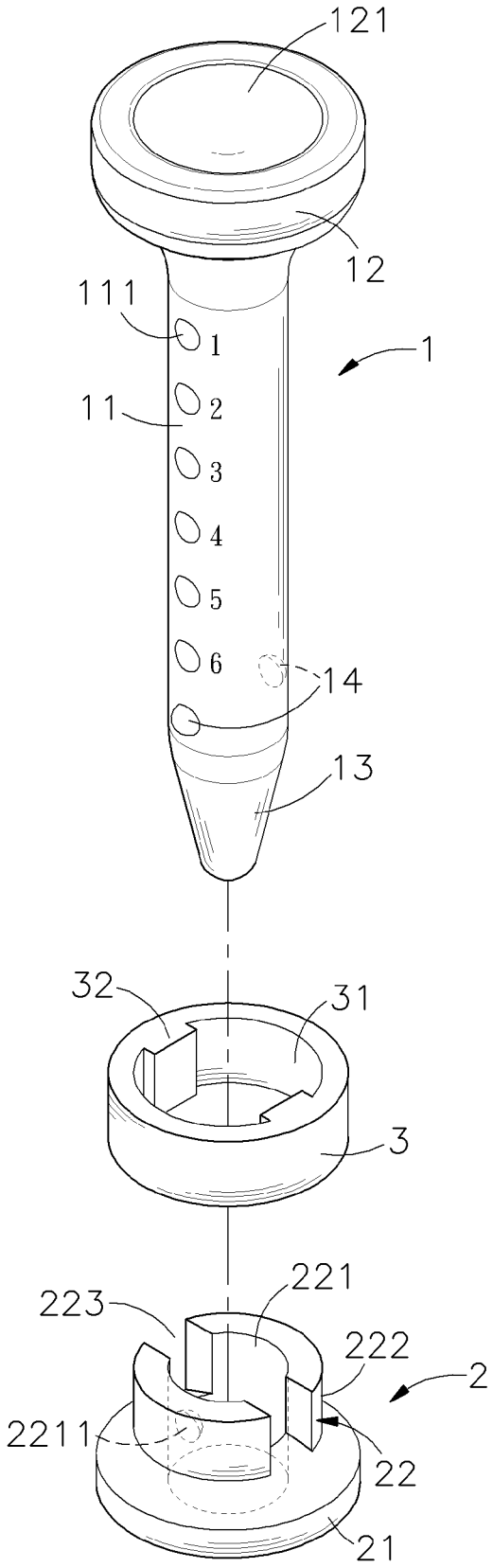
FIG. 6 is an exploded view of an adjustable golf tee assembly in accordance with a second embodiment of the present invention.

FIG. 6 illustrates an adjustable golf tee assembly in accordance with a second embodiment of the present invention. This second embodiment is substantially similar to the aforesaid first embodiment with the exception that the golf tee 1 of this second embodiment comprises anti-escape means 14; the locating ring 3 of this second embodiment comprises a plurality of inner ribs 32 that fit the longitudinal crevices 223 of the tee holder 2. Further, the anti-escape means 14 can be comprised of a plurality of raised portions protruded from the periphery of the shank 11 adjacent to the conical tip 13. When inserting the shank 11 of the golf tee 1 through the locating ring 3 and the center through hole 221 of the tee holder 2, the anti-escape means 14 is forced against the inside wall of the upright stub tube 22, causing the upright stub tube 22 to expand radially outwards. After inserting the anti-escape means 14 through the center through hole 221 of the tee holder 2, the anti-escape means 14 is stopped below the flat base 21 of the tee holder 2, preventing escape of the tee holder 2 and the locating ring 3 from the shank 11 of the golf tee 1. When wishing to separate the golf tee 1 from the tee holder 2, the user must impart a pulling force to the golf tee 1 relative to the tee holder 2 to force the anti-escape means 14 against the inside wall of the flat base 21 of the tee holder 2, causing the tee holder 2 to deform elastically.

Figure 7:
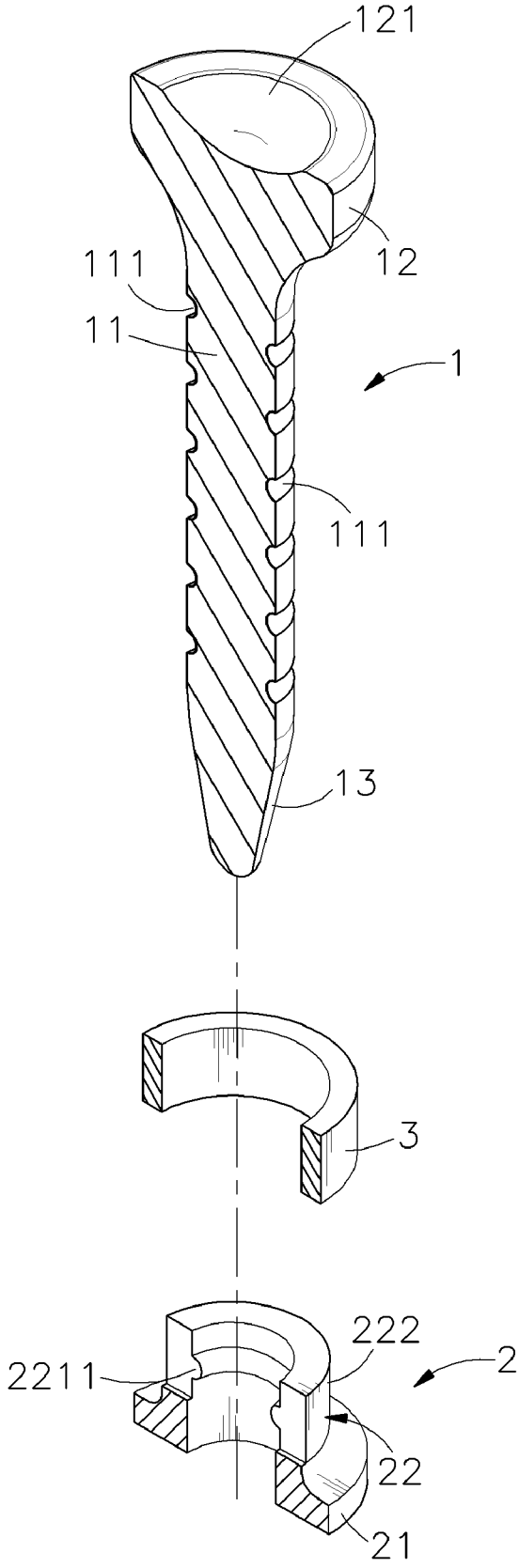
FIG. 7 is a sectional elevation of an adjustable golf tee assembly in accordance with a third embodiment of the present invention.

FIG. 7 illustrates an adjustable golf tee assembly in accordance with a third embodiment of the present invention. This third embodiment is substantially similar to the aforesaid first embodiment with the exception that the positioning portions 111 of the golf tee 1 of this third embodiment are annular grooves extending around the periphery of the shank 11 at different elevations; the positioning portion 2211 of the tee holder 2 is an inside annular flange extending around the inside wall of the upright stub tube 22 and adapted for engaging one annular groove of the golf tee 1.

Figure 8:
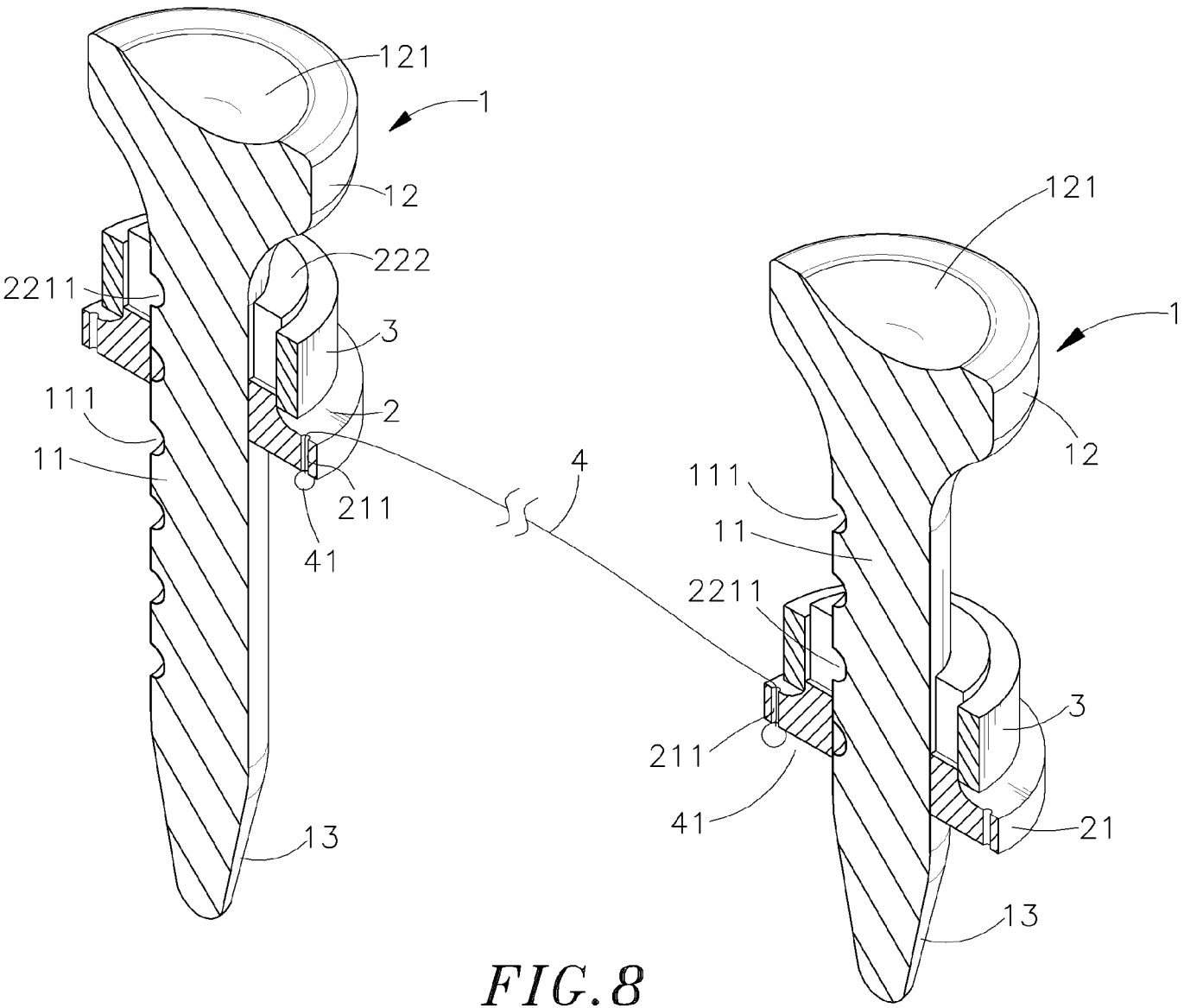
FIG. 8 is a sectional elevation of an adjustable golf tee assembly in accordance with a fourth embodiment of the present invention.

Referring to FIG. 8, the flat base 21 of the tee holder 2 has a wire hole 211 cut through the top and bottom sides so that a cord member 4 can be fastened to the wire hole 211 to link two adjustable golf tee assemblies. As illustrated, the cord member 4 is inserted through the wire holes 211 of two adjustable golf tee assemblies, having a stop member 41 respectively affixed to each of the two ends thereof. The stop member 41 has a diameter greater than the wire hole 211, preventing escape of the adjustable golf tee assemblies from the cord member 4. During application, the two adjustable golf tee assemblies that are linked by the cord member 4 are fastened to the ground. If one adjustable golf tee assembly jumps away upon hitting of the ball, the other golf tee assembly holds the cord member 4 to drag the jumped adjustable golf tee assembly, avoiding the jumped adjustable golf tee assembly missing.

Figure 2:
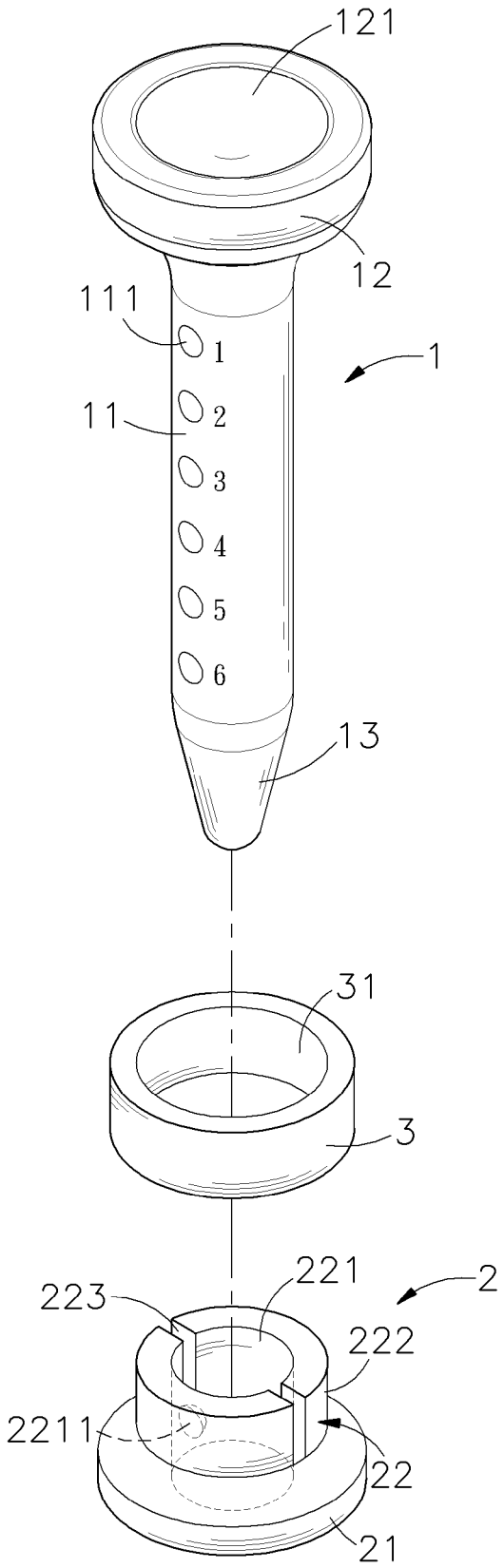
FIG. 2 is an exploded view of the adjustable golf tee assembly in accordance with the first embodiment of the present invention.
Figure 3:
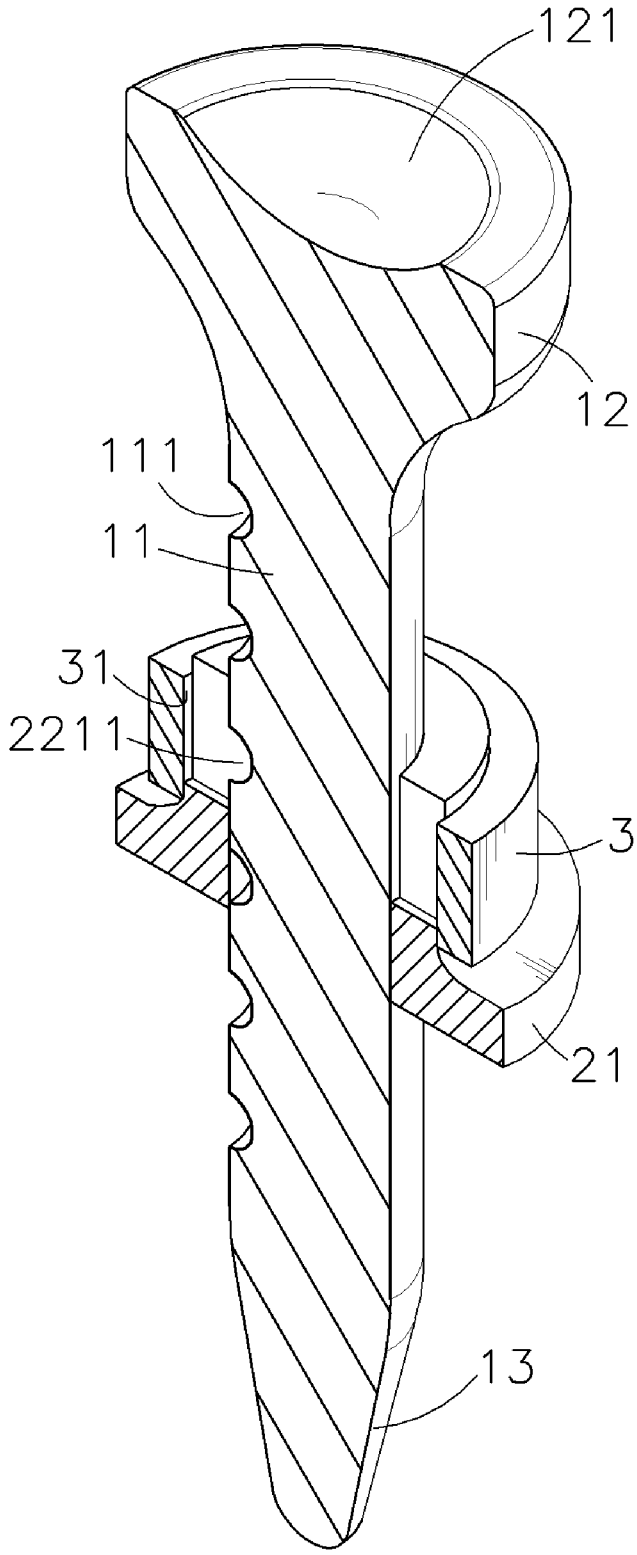
FIG. 3 is a sectional elevation of the adjustable golf tee assembly shown in FIG. 1.
Figure 4:
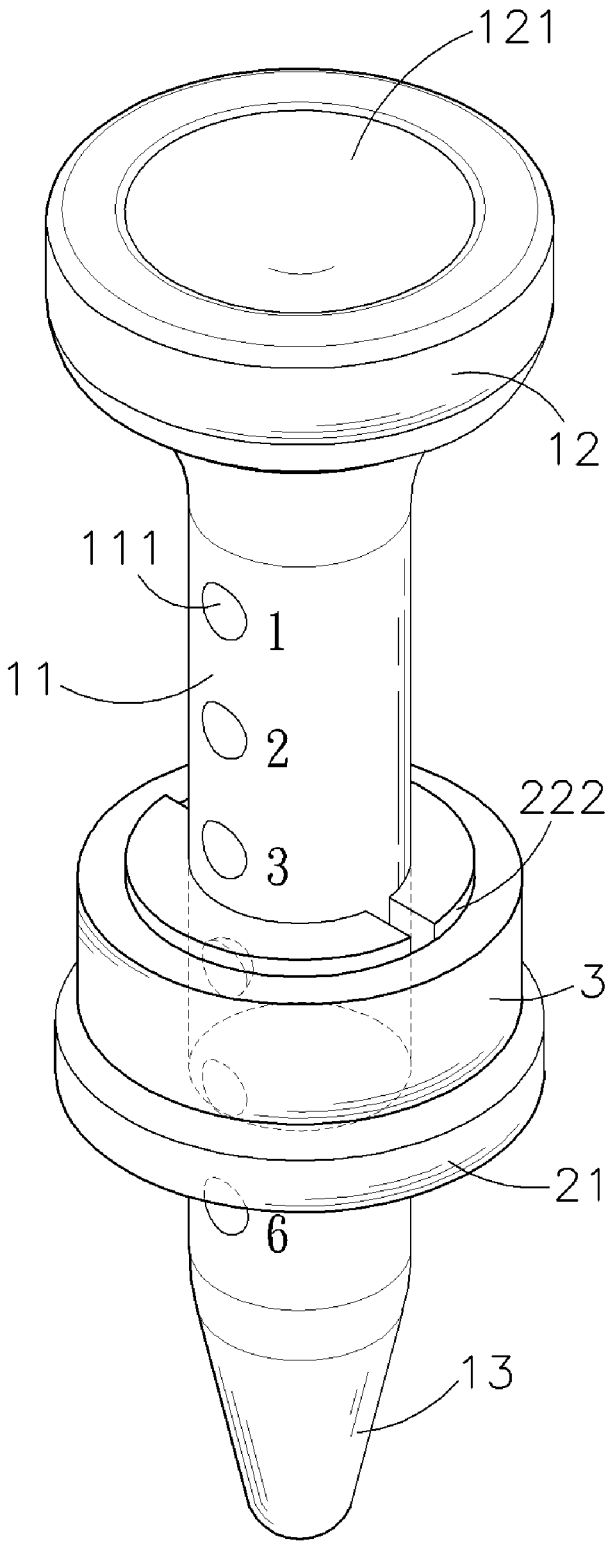
FIG. 4 corresponds to FIG. 1, showing the elevation of the tee holder and the locating ring adjusted relative to the golf tee.
Figure 5:
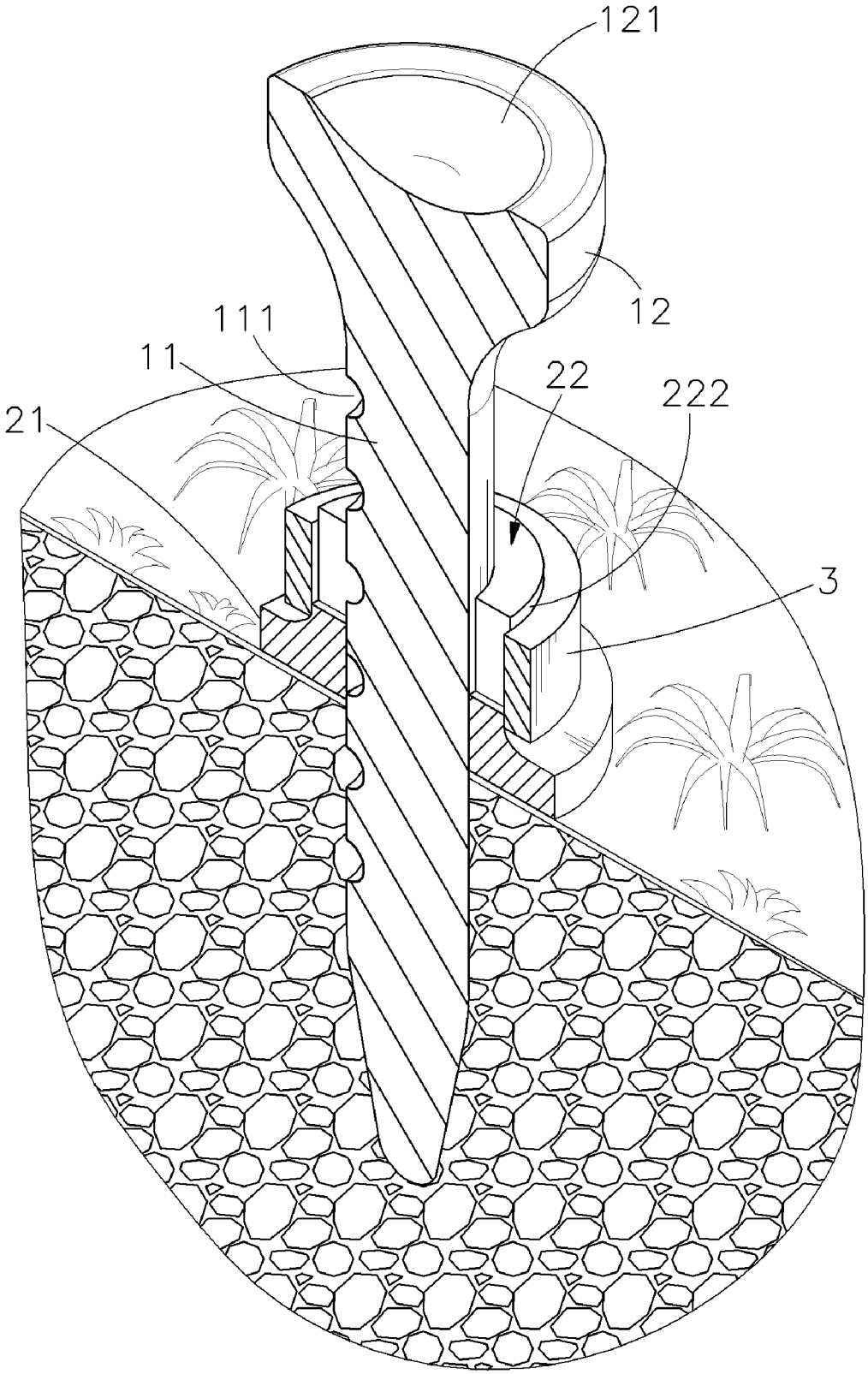
FIG. 5 is a schematic sectional elevation, showing the adjustable golf tee assembly of the first embodiment of the present invention fastened to the ground.

Referring to FIGS. 2 and 6, the upright stub tube 22 has a plurality of longitudinal crevices 223 that enable the upright stub tube 22 to be deformed elastically. Alternatively, the tee holder 2 can be directly molded from an elastic material, for example, silicon rubber, rubber or elastic resin without the longitudinal crevices 223.

Figure 9:
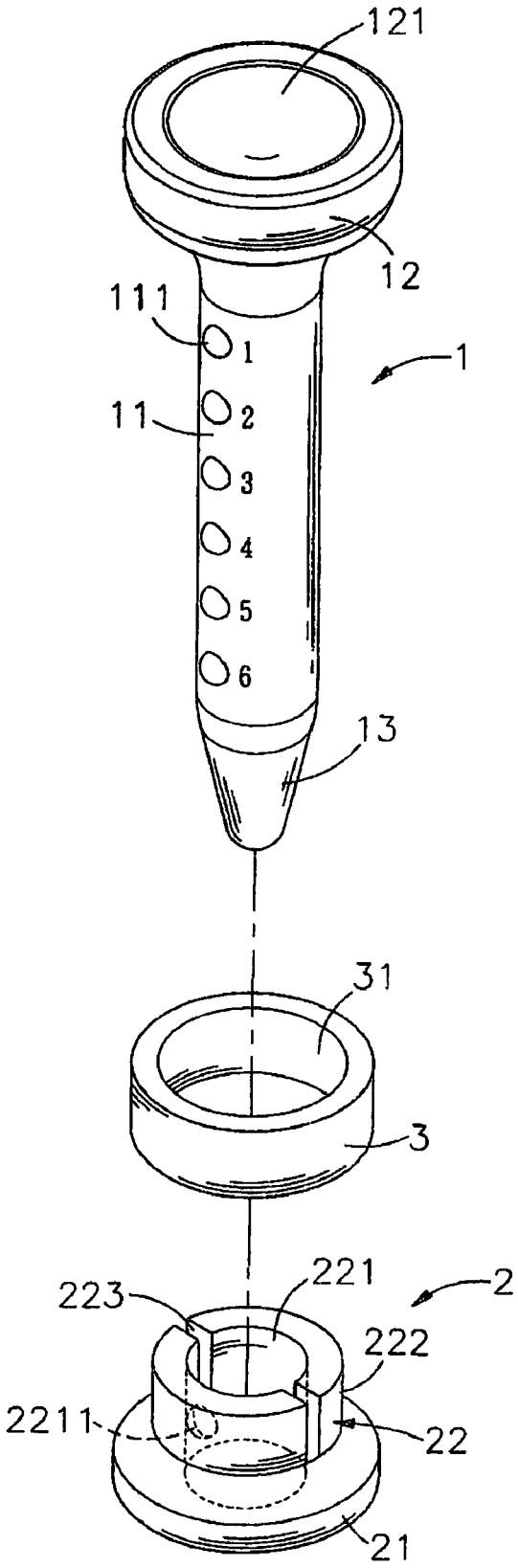
FIG. 9 is an exploded view of the adjustable golf tee assembly in accordance with a fifth embodiment of the present invention.

Referring to FIG. 9, which illustrates an exploded view of the adjustable golf tee assembly in accordance with a fifth embodiment of the present invention. The positioning portions 111 of the golf tee 1 can be protruding blocks; the positioning portion 2211 of the tee holder 2 can be a recessed hole adapted for receiving one positioning portion 111 of the golf tee 1.

Figure 10:
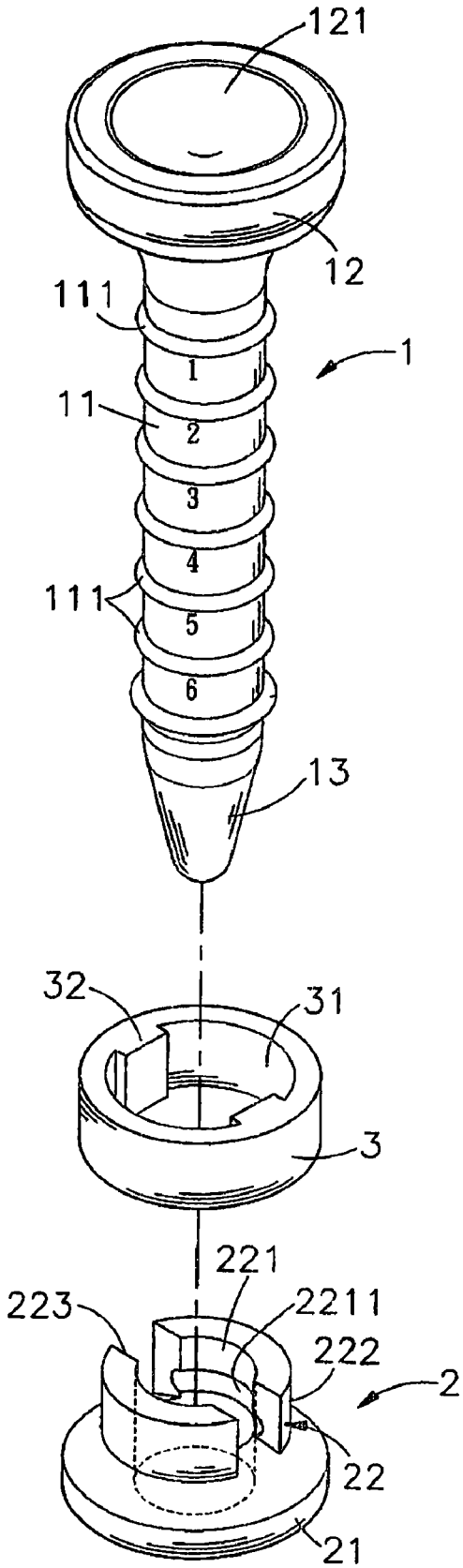
FIG. 10 is an exploded view of the adjustable golf tee assembly in accordance with a sixth embodiment of the present invention.

Referring to FIG. 10, which illustrates an exploded view of the adjustable golf tee assembly in accordance with a sixth embodiment of the present invention. The positioning portions 111 of the golf tee 1 can be annular flanges extending around the periphery of the shank 11 at different elevations; the positioning portion 2211 of the tee holder 2 can be an inside annular groove extending around the inside wall of the upright stub tube 22 for engagement with one annular flange of the golf tee 1.

Figure 11:
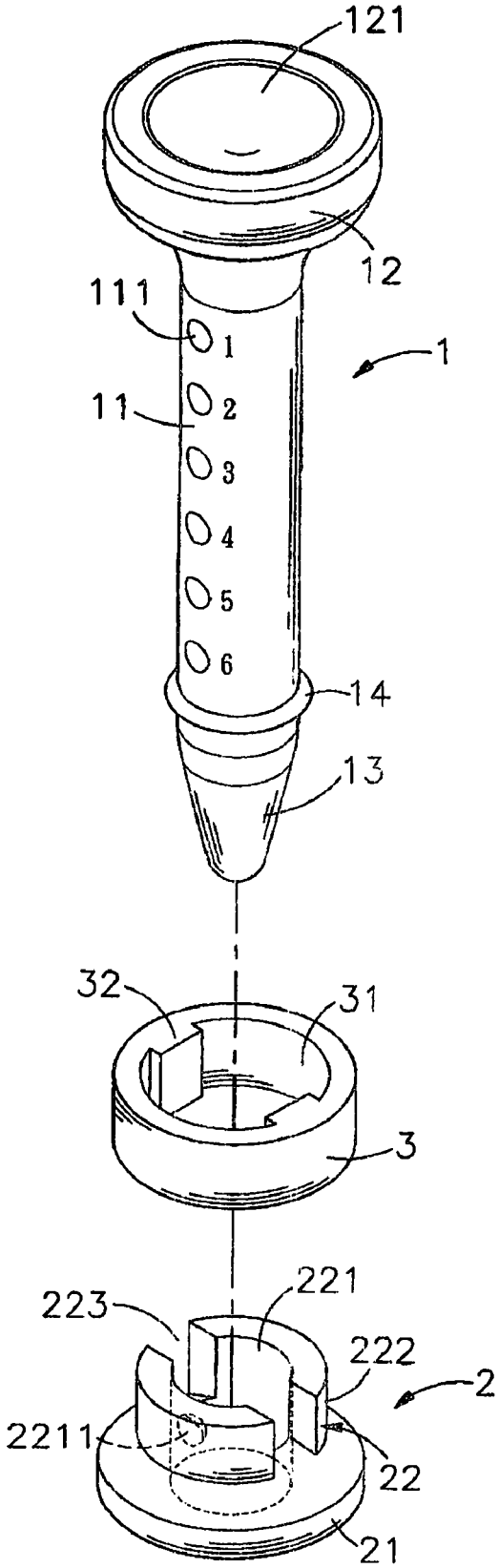
FIG. 11 is an exploded view of the adjustable golf tee assembly in accordance with a seventh embodiment of the present invention.

Referring to FIG. 11, which illustrates an exploded view of the adjustable golf tee assembly in accordance with a seventh embodiment of the present invention. The anti-escape means 14 can be an outside annular flange extending around the periphery of the shank 11 adjacent to the conical tip 13.

As described above, the adjustable golf tee assembly of the present invention has the following features and benefits:

1. The tee holder 2 can be made of an elastic material and/or provide with longitudinal crevices 223. When inserting the golf tee 1 through the center through hole 221, the longitudinal crevices 223 allows the upright stub tube 22 of the tee holder 2 to expand radially outwards so that the golf tee 1 can be moved axially relative to the tee holder 2 to the desired elevation to have the selected positioning portion 111 of the golf tee 1 be forced into engagement with the positioning portion 2211 of the tee holder 2.

2. After engagement of the selected positioning portion 111 of the golf tee 1 with the positioning portion 2211 of the tee holder 2, the locating ring 3 is sleeved onto the upright stub tube 22 of the tee holder 2, holding the selected positioning portion 111 of the golf tee 1 in positive engagement with the positioning portion 2211 of the tee holder 2.

3. The longitudinal crevices 223 allow the upright stub tube 22 of the tee holder 2 to be elastically deformed for easy adjustment of the elevation of the golf tee 1 relative to the tee holder 2. After adjustment of the elevation of the golf tee 1 relative to the tee holder 2, the locating ring 3 is sleeved onto the upright stub tube 22 of the tee holder 2 to lock the golf tee 1 and the tee holder 2. Further, the matching design between the positioning portions 111 of the golf tee 1 and the positioning portion 2211 of the tee holder 2 allows the user to clean sands from the adjustable golf tee assembly easily.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An adjustable golf tee assembly comprising:

a golf tee, said golf tee comprising a shank, a plurality of positioning portions formed in the periphery of said shank at different elevations, a head disposed at a top end of said shank for holding a golf ball, and a conical tip axially downwardly extended from a bottom end of said shank for fastening to the ground;

a tee holder made of an elastic material, said tee holder comprising a flat base, an upright stub tube perpendicularly upwardly extending from said flat base, a center through hole cut through top and bottom sides of said flat base and surrounded by said upright stub tube, said upright stub tube including at least one longitudinal crevice and a positioning portion formed on an inside wall of said upright stub tube for engagement with one of said positioning portions of said golf tee; and a locating ring for sleeving onto said upright stub tube of said tee holder to hold said positioning portion of said tee holder in engagement with one positioning portion of said golf tee, said locating ring having an inner diameter fitting an outer diameter of the upright stub tube of said tee holder, and said locating ring including at least one inner rib for fitting said at least one longitudinal crevice of said upright stub tube.

2. The adjustable golf tee assembly as claimed in claim 1, wherein said positioning portions of said golf tee are recessed holes formed in the periphery of said shank at different elevations; said positioning portion of said tee holder is a protruding block for fitting said recessed holes of said golf tee.

3. The adjustable golf tee assembly as claimed in claim 1, wherein said positioning portions of said golf tee are protruding blocks protruded from the periphery of said shank at different elevations; said positioning portion of said tee holder is a recessed hole for receiving one said protruding block of said golf tee.

4. The adjustable golf tee assembly as claimed in claim 1, wherein said positioning portions of said golf tee are annular grooves extending around the periphery of said shank at different elevations; said positioning portion of said tee holder is an inside annular flange extending around the inside wall of said upright stub tube for engaging one said annular groove of said golf tee.

5. The adjustable golf tee assembly as claimed in claim 1, wherein said positioning portions of said golf tee are annular flanges extending around the periphery of said shank at different elevations; said positioning portion of said tee holder is an inside annular groove extending around the inside wall of said upright stub tube for receiving one said annular flange of said golf tee.

6. The adjustable golf tee assembly as claimed in claim 1, wherein said tee holder is molded from silicon rubber.

7. The adjustable golf tee assembly as claimed in claim 1, wherein said tee holder is molded from rubber.

8. The adjustable golf tee assembly as claimed in claim 1, wherein said tee holder is molded from an elastic resin.

9. The adjustable golf tee assembly as claimed in claim 1, wherein said golf tee comprises anti-escape means disposed at the periphery of said shank adjacent to said conical tip for avoiding escaping of said tee holder from said golf tee after insertion of said shank of said golf tee through said center through hole of said tee holder; said anti-escape means comprises a plurality of raised portions protruded from the periphery of said shank adjacent to said conical tip.

10. The adjustable golf tee assembly as claimed in claim 1, wherein said tee holder comprises a wire hole cut through top and bottom sides of said flat base, and a cord member inserted through said wire hole to secure said tee holder to a tee holder of an external adjustable golf tee assembly, said cord member having a stop member respectively fixedly provided at each of two distal ends thereof, said stop member having a diameter greater than said wire hole.

11. The adjustable golf tee assembly as claimed in claim 1, wherein said golf tee comprises anti-escape means disposed at the periphery of said shank adjacent to said conical tip for avoiding escaping of said tee holder from said golf tee after insertion of said shank of said golf tee through said center through hole of said tee holder; said anti-escape means comprises an outside annular flange extending around the periphery of said shank adjacent to said conical tip.

* * * * *